US010044146B2

(12) United States Patent
Adrian

(10) Patent No.: US 10,044,146 B2
(45) Date of Patent: Aug. 7, 2018

(54) PASS-THROUGH CONNECTOR

(71) Applicant: Facebook, Inc., Menlo Park, CA (US)

(72) Inventor: Jason David Adrian, San Jose, CA (US)

(73) Assignee: Facebook, Inc., Menlo Park, CA (US)

( * ) Notice: Subject to any disclaimer, the term of this patent is extended or adjusted under 35 U.S.C. 154(b) by 80 days.

(21) Appl. No.: 15/132,516

(22) Filed: Apr. 19, 2016

(65) Prior Publication Data

US 2017/0302027 A1 Oct. 19, 2017

(51) Int. Cl.
*H01R 13/648* (2006.01)
*H01R 13/73* (2006.01)
*H01R 107/00* (2006.01)

(52) U.S. Cl.
CPC ..... *H01R 13/648* (2013.01); *H01R 13/73* (2013.01); *H01R 2107/00* (2013.01)

(58) Field of Classification Search
CPC ..... H01R 13/648; H01R 13/11; H01R 13/10
See application file for complete search history.

(56) References Cited

U.S. PATENT DOCUMENTS 4,212,510 A * 7/1980 Ritchie ..... H01R 13/7197 333/183
4,808,115 A * 2/1989 Norton ..... G02B 6/381 361/721
5,437,563 A * 8/1995 Kihira ..... H01R 13/5219 439/275
5,599,198 A * 2/1997 Wang ..... H01R 24/46 439/188
5,658,171 A * 8/1997 Pauza ..... H01R 13/5202 439/675
5,791,941 A * 8/1998 Wang ..... H01R 13/52 439/589
7,591,677 B2 * 9/2009 Bade ..... H01R 13/514 439/540.1
8,715,016 B2 * 5/2014 DeBock ..... H01R 13/514 439/701
9,711,919 B2 * 7/2017 Holland ..... H01R 24/44
2007/0128938 A1 * 6/2007 Kuo ..... H01R 13/65802 439/607.41
2012/0135648 A1 * 5/2012 Morikawa ..... H01R 43/048 439/885

(Continued)

*Primary Examiner* — James Harvey
(74) *Attorney, Agent, or Firm* — FisherBroyles, LLP

(57) ABSTRACT

Technology is provided for a pass-through connector including a connector body having first and second end portions. The first end is configured as an internal style connector and has a pair of receptacle openings. The connector body also includes a second end portion configured as an external style connector and has a pair of receptacle openings. A conductive shroud is attached to the second end portion of the connector body and can include mounting flanges to facilitate attachment to a panel or bulkhead. Terminal conductors are disposed in the connector body and extend between the pairs of receptacle openings. The terminal conductors are configured to releasably engage a plug of a Mini-SAS HD cable assembly, for example, when coupled to the first or second end. Each terminal conductor is a single continuous piece of conductive material to directly connect the cable assembly connectors together with minimal impedance discontinuity.

11 Claims, 3 Drawing Sheets

(56) References Cited

U.S. PATENT DOCUMENTS

| | | | | |
|---|---|---|---|---|
| 2013/0078864 | A1* | 3/2013 | Tsai | H01R 13/11 439/660 |
| 2013/0095676 | A1* | 4/2013 | Wu | H01R 9/2408 439/76.1 |
| 2013/0130535 | A1* | 5/2013 | Plazio | H01R 13/506 439/350 |
| 2013/0237092 | A1* | 9/2013 | Rubens | H01R 13/6596 439/607.23 |
| 2013/0295799 | A1* | 11/2013 | Ishii | H01R 11/01 439/884 |
| 2015/0340796 | A1* | 11/2015 | Lu | H01R 13/46 439/352 |
| 2017/0131747 | A1* | 5/2017 | Chen | G06F 1/183 |
| 2017/0279219 | A1* | 9/2017 | Humbert | H01R 13/5808 |
| 2017/0302027 | A1* | 10/2017 | Adrian | H01R 13/648 |

* cited by examiner

PASS-THROUGH CONNECTOR

TECHNICAL FIELD

This patent application is directed to computer hardware connectors and, more specifically, to serial communication connectors.

BACKGROUND

SAS is a point-to-point serial protocol that moves data to and from computer storage devices such as hard drives and tape drives. SAS stands for Serial Attached SCSI (Small Computer System Interface). SAS connectors come in several different variants including mini-SAS, mini-SAS HD, mSAS, and iSAS, for example. Traditionally, the mini-SAS and mini-SAS HD connectors, for example, comprise a connector portion configured to mate with a cable assembly connector and a board mount portion configured to mate with a printed circuit board.

BRIEF DESCRIPTION OF THE DRAWINGS

Embodiments of the pass-through connectors introduced herein may be better understood by referring to the following Detailed Description in conjunction with the accompanying drawings, in which like reference numerals indicate identical or functionally similar elements.

Figure 1:
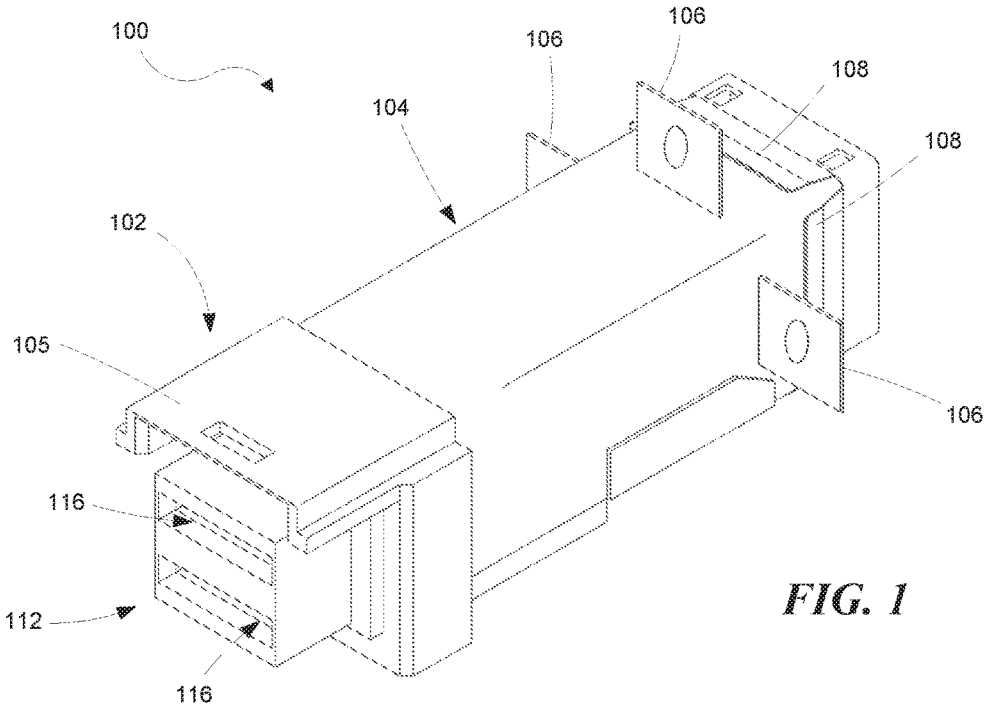
FIG. 1 is an isometric view of a pass-through connector according to a representative embodiment as viewed from the internal connector.

The headings provided herein are for convenience only and do not necessarily affect the scope or meaning of the claimed embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to limit the embodiments described. On the contrary, the embodiments are intended to cover all modifications, equivalents, and alternatives falling within the scope of the embodiments as defined by the appended claims.

DETAILED DESCRIPTION

Overview

In order to connect mini-SAS or mini-SAS HD cables together with conventional connectors, two corresponding connectors must be mounted to a printed circuit board with circuit board traces connecting the two connectors. Each change in conductor material and solder joint between the two connectors is an impedance discontinuity that can have adverse effects on the data transfer rate of the associated data system. Provided herein are pass-through connectors that can directly connect two SAS cables, such as mini-SAS or mini-SAS HD cables, without the intervening impedance discontinuities of conventional connectors.

In an embodiment, the pass-through connector is configured for use with Mini-SAS HD cable assemblies. The pass-through connector comprises a connector body including first and second opposed end portions. The first end portion is configured as an internal style connector and has a pair of first receptacle openings. The connector body also includes a second end portion configured as an external style connector and has a pair of second receptacle openings. A conductive shroud is attached to the second end portion of the connector body and can include mounting flanges to facilitate attachment to a panel, bulkhead, or other mounting structure. A plurality of continuous terminal conductors are disposed in the connector body and extend between the pair of first receptacle openings and the pair of second receptacle openings. The terminal conductors are configured to releasably engage a plug of a Mini-SAS HD cable assembly when coupled to the first or second end portions. Each terminal conductor comprises a single continuous piece of conductive material, such as metal. Thus, the terminal conductors directly connect the cable assembly connectors together with minimal discontinuity.

GENERAL DESCRIPTION

Various examples of the devices introduced above will now be described in further detail. The following description provides specific details for a thorough understanding and enabling description of these examples. One skilled in the relevant art will understand, however, that the techniques discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

Figure 2:
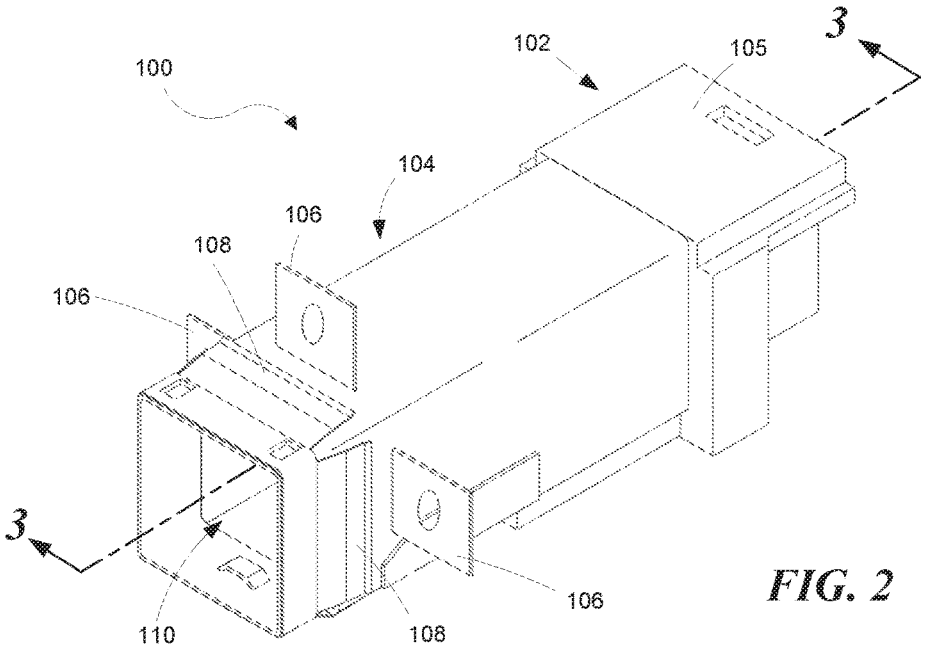
FIG. 2 is an isometric view of the pass-through connector shown in FIG. 1 as viewed from the external connector.

As shown in FIGS. 1 and 2, the pass-through connector 100 includes a connector body 102 and a conductive shroud or cage 104 attached to the connector body 102. With reference to FIG. 1, the connector body 102 includes a first end portion 112 configured to mate with an internal style mini-SAS HD cable connector (e.g., plug). The first end portion 112 includes a pair of rectangular receptacle openings 116 and a connector latch 105. With further reference to FIG. 2, the conductive shroud 104 includes an opening 110 configured to receive an external style mini-SAS HD cable connector. The shroud 104 includes one or more mounting flanges 106 to facilitate mounting the connector 100 to an external panel of an enclosure, for example. The conductive shroud 104 also includes one or more electromagnetic interference (EMI) shield tabs 108. In some embodiments, each EMI shield tab 108 can comprise multiple fingers.

Figure 3:
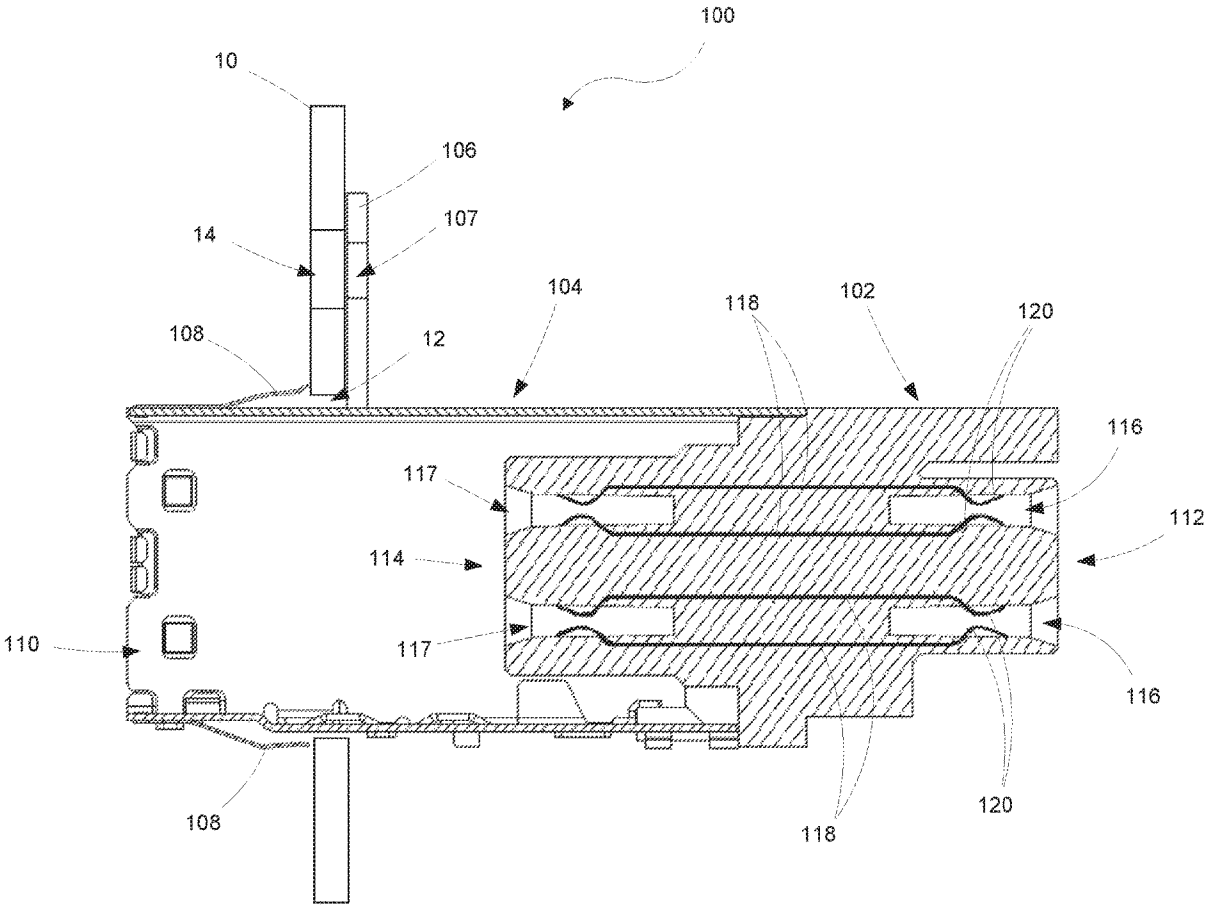
FIG. 3 is a cross section of the pass-through connector taken about line 3-3 in FIG. 2.

As shown in FIG. 3, the connector body 102 includes a second end portion 114 that is surrounded by the conductor shroud 104. The second end portion 114 also includes a pair of receptacle openings 117. A plurality of terminal conductors 118 are disposed in the connector body 102 and extend between the receptacle openings 116 and 117. It can be appreciated from the figure that the terminal conductors 118 each comprise a single continuous piece of conductive material. In other words, there are no impedance discontinuities between the receptacle openings 116 and 117. In some embodiments, each terminal conductor 118 includes arcuate end portions 120 configured to engage a plug of a Mini-SAS HD cable assembly when coupled to the first or second end portion.

As mentioned above, the shroud 104 includes mounting flanges 106 to mount the pass-through connector 100 to a mounting structure, such as a panel 10 that can be part of an enclosure, for example. The EMI shield tabs 108 contact the panel 10 to help ensure continuity between the shroud 104 and the panel 10, thereby enhancing EMI protection. The panel 10 includes a connector aperture 12 and surrounding mounting holes 14. The mounting flanges 106 include apertures 107 that align with the mounting holes 14. Accordingly, suitable fasteners (not shown) can be used to mount the pass-through connector to the panel.

In some embodiments, the connector body 102 comprises a high-temperature glass-filled thermoplastic. In some embodiments, the shroud 104 is comprised of a nickel silver alloy and the EMI shield tabs 108 are comprised of copper alloy with nickel plating. In some embodiments, the terminal conductors 118 are comprised of copper alloy with nickel and gold plating.

Figure 4:
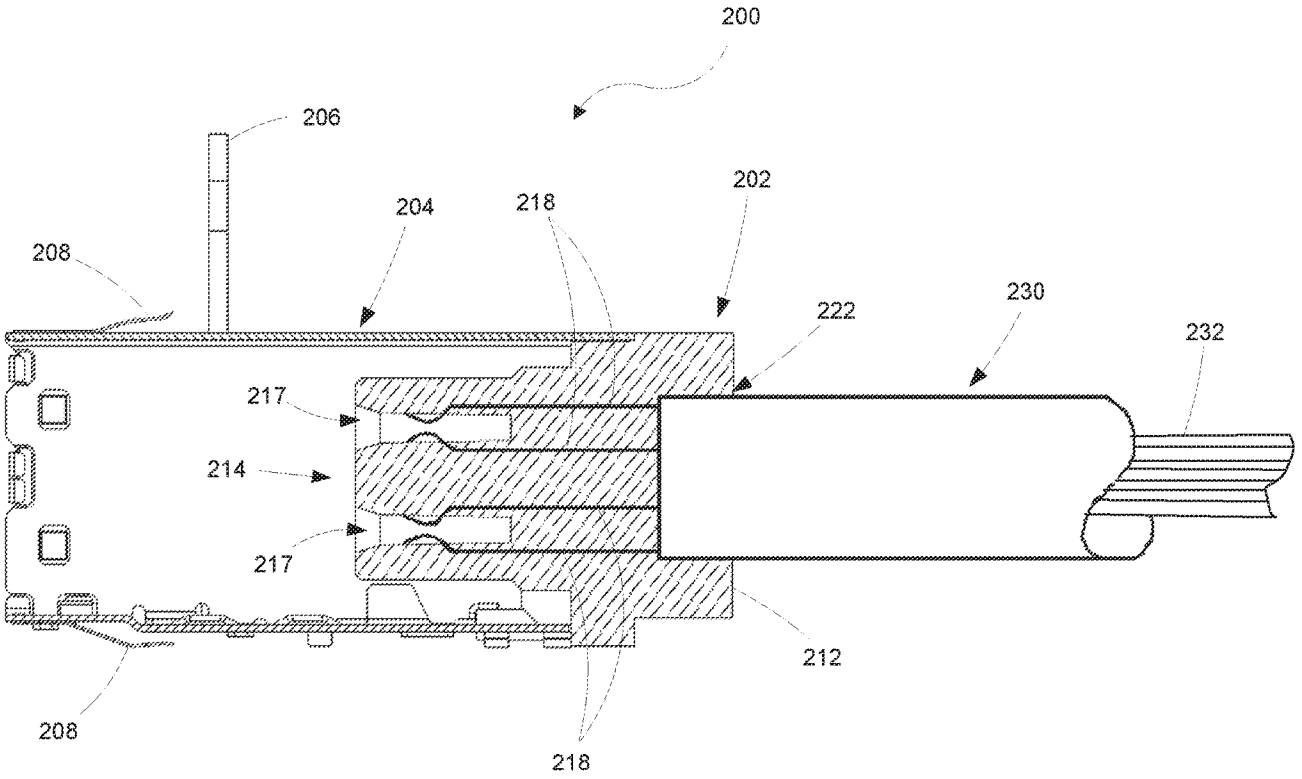
FIG. 4 is a cross sectional view of a pass-through cable assembly according to a representative embodiment.

Also disclosed herein is a pass-through cable assembly 200 shown in FIG. 4. The cable assembly 200 includes an external connector portion (e.g., 204, 214) similar to that described above with respect to FIGS. 1-3. The connector body 202 includes a first end portion 212 having a cable aperture 222 configured to receive a cable 230. Connector body 202 has a second end portion 214 with a pair of receptacle openings 217 configured to mate with an external style mini-SAS HD cable connector. A plurality of terminal conductors 218 are disposed in the connector body 202 and extend between the receptacle openings 217 and the cable aperture 222. The cable 230 includes a plurality of conductors 232 (e.g., wires) mechanically and/or electrically connected to corresponding terminal conductors 218. The cable 230 can be terminated opposite the connector body 202 at one or more connector plugs (not shown), such as mini-SAS HD cable connectors. The pass-through cable assembly 200 also includes a conductive shroud 204 attached to the conductor body 202. A plurality of mounting flanges 206 extend from the conductive shroud 204 to facilitate mounting to a panel. The conductive shroud 204 also includes one or more EMI shield tabs 208.

Although the embodiments described herein are described with respect to a mini-SAS HD connector, the technology can also be applied to mini-SAS, mSAS, iSAS and other styles of connectors.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments. Accordingly, the embodiments are not limited except as by the appended claims.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A pass-through connector for use with Mini-SAS HD cable assemblies, the connector comprising:

a connector body including first and second opposed end portions each configured as a Mini-SAS HD connector, the first end portion having a pair of first receptacle openings and the second end portion having a pair of second receptacle openings;

a conductive shroud attached to the second end portion of the connector body; and a plurality of continuous terminal conductors disposed in the connector body and extending between the pair of first receptacle openings and the pair of second receptacle openings, whereby the terminal conductors can releasably engage a plug of a Mini-SAS HD cable assembly when coupled to the first or second end portion.

2. The pass-through connector of claim 1, wherein the first pair of receptacle openings and the second pair of receptacle openings each have a rectangular shape.

3. The pass-through connector of claim 1, further comprising one or more mounting flanges extending from the conductive shroud.

4. The pass-through connector of claim 1, further comprising one or more electromagnetic interference shield tabs extending from the conductive shroud.

5. The pass-through connector of claim 1, wherein the first end portion is configured as an internal Mini-SAS HD connector and the second end portion is configured as an external Mini-SAS HD connector.

6. A pass-through connector, comprising:

a connector body including first and second opposed end portions, the first end portion configured as an internal Mini-SAS HD connector and having a first receptacle opening and the second end portion configured as an external Mini-SAS HD connector having a second receptacle opening;

a plurality of terminal conductors disposed in the connector body and extending between the first and second receptacle openings; and a conductive shroud attached to the second end portion of the connector body.

7. The pass-through connector of claim 6, wherein the plurality of terminal conductors each comprise a continuous conductor.

8. The pass-through connector of claim 6, wherein the first and second receptacle openings have a rectangular shape.

9. The pass-through connector of claim 8, wherein the plurality of terminal conductors include one or more first terminal conductors extending between the first and second receptacle openings along a first side of the first and second receptacle openings and one or more second terminal conductors positioned opposite the one or more first terminal conductors extending between the first and second receptacle openings along a second side of the first and second receptacle openings.

10. The pass-through connector of claim 6, further comprising one or more mounting flanges extending from the conductive shroud.

11. The pass-through connector of claim 6, further comprising one or more electromagnetic interference shield tabs extending from the conductive shroud.

* * * * *